US005273100A

United States Patent [19]

Arici

[11] Patent Number: 5,273,100

[45] Date of Patent: Dec. 28, 1993

[54] APPARATUS FOR THE CONTINUOUS CASTING OF METALS AND OF STEEL IN PARTICULAR

[75] Inventor: Stefano Arici, Villa Carcina, Italy

[73] Assignee: Danieli & C. Officine Meccaniche, Buttrio, Italy

[21] Appl. No.: 978,159

[22] Filed: Nov. 17, 1992

Related U.S. Application Data

[63] Continuation of Ser. No. 627,929, Dec. 17, 1990, abandoned, which is a continuation of Ser. No. 426,419, Oct. 25, 1989, abandoned.

[30] Foreign Application Priority Data

Oct. 31, 1988 [IT] Italy ..... 5232 A/88

[51] Int. Cl.[5] ..... B22D 11/04

[52] U.S. Cl. ..... 164/418; 164/436; 164/440

[58] Field of Search ..... 164/418, 436, 440, 443, 164/491, 459

[56] References Cited

U.S. PATENT DOCUMENTS 4,480,976 11/1984 Vaubel et al. ..... 164/416
4,789,021 12/1988 Ahrens ..... 164/418

FOREIGN PATENT DOCUMENTS 55-36088 3/1980 Japan ..... 164/440
58-86957 5/1983 Japan ..... 164/440
63-76739 4/1988 Japan ..... 164/440

*Primary Examiner*—Richard K. Seidel
*Assistant Examiner*—Rex E. Pelto
*Attorney, Agent, or Firm*—Antonelli, Terry, Stout & Kraus

[57] ABSTRACT

Apparatus for the continuous casting of metals and of steel in particular, which is suitable for vertical, curved or almost horizontal casting and comprises in association with a main ingot mold (10) a downstream mold (12) positioned immediately downstream of the main ingot mold (10) and consisting of a plurality of independent elements, the downstream mold (12) being cooled with water, the apparatus providing for the formation of ingots with a round, oval, square or like section, the downstream mold (12) consisting of a plurality of independent, movable shell elements (15) which can align themselves and have sides (17) not parallel to the direction of sliding of the metal, the sides (17) of each shell element (15) delimiting in conjunction with the sides (17) of the neighboring shell elements (15) clefts (18) which have a development not parallel to, or according to a spiral in relation to, the axis and surface of the ingot being formed.

10 Claims, 3 Drawing Sheets

APPARATUS FOR THE CONTINUOUS CASTING OF METALS AND OF STEEL IN PARTICULAR

This application is a continuation of application Ser. No. 07/627,929, filed Dec. 17, 1990, now abandoned, which is a continuation of application Ser. No. 07/426,419, filed Oct. 25, 1989 now abandoned.

This invention concerns the field of foundries and, to be more exact, an apparatus for the continuous casting of metals and, in particular but not only, steel and the formation of ingots, whether they be round or oval or have a square section or analogous sections.

The continuous casting to which this invention can be applied may have its casting axis vertical and straight, vertical and round or horizontal or almost horizontal.

The problems involved in the process of continuous casting of steel are well known and concern mainly the system to cool the ingot produced and may have an unfavorable effect on the quality of the materials obtained.

In the present state of the art these problems have still not been overcome satisfactorily even where a downstream mold is employed in prolongation of the main mold itself and is cooled with water for the passage and thermal conditioning of the ingot.

In general, when the cast metal passes into the main mold and downstream mold, it undergoes a speedy removal of heat in its zone of contact with the walls of the molds and is thus solidified quickly.

The solidification takes place in the form of crystals, which grow perpendicularly to the walls of the main mold and downstream mold.

As solidification proceeds, the ingot tends at a given moment to become detached from the guiding walls, with a resulting variation in the conditions of transmission of the heat and therefore of the cooling.

At this point, within the still molten metal of the core of the ingot, the laws of crystallization vary and the nuclei of the crystallization grow in all directions, thus leading to a confused structure. The resulting material, therefore, comprises outer, intermediate and inner zones consisting of different crystals.

In practice the progress of the solidification leads to a heterogeneous structure, which may be the cause of a great number of shortcomings such as the fragility of the ingot, the formation of cracks due to inner tensions, the presence of a central zone of scanty cohesion, etc., which have an unfavurable effect on the employment and subsequent processing of the ingot.

In any event the casting techniques employed so far cannot remedy these shortcomings fully. The employment of the water-cooled downstream mold in its present form does not enable the outcome of the casting to be improved.

In this connection, downstream molds are in fact known which form ingots with a square section and downstream molds are also known which form ingots with a round section; the former downstream molds consist of four or more elements or plates positioned according to the sides of a square and distanced at their corners of convergence, whereas the latter downstream molds consist of shell elements arranged along a circumference.

In both cases the adjacent sides of the elements forming the downstream molds are parallel to the direction of sliding of the metal and define clefts which extend along the ingot.

These clefts obviously leave the metal, passing into the downstream mold, exposed to direct contact with the cooling fluid and therefore determine preferred continuous lengthwise strips of solidification of the metal.

In fact, the metal solidifies along these strips more quickly than in the neighbouring zones and enhances the conditions that contribute to the variation of the structure and to impairment of the homogeneous formation of the material.

U.S. Pat. No. 2,698,467 (DE 1.252.371—FIG. 3) shows in FIG. 11 a downstream mold portion having helicoidal grooves in its periphery, but this patent does not teach how to adapt the dimensions of the downstream mold to the actual dimensions of the ingot so that it does not prevent separation of the downstream mold from the ingot; nor does it teach how to obtain the required pressure on the ingot so as to ensure its peripheral and dimensional continuity.

Moreover, the elements forming the known downstream molds are normally kept in their working arrangement by means of springs, but the springs, when at work, do not make possible the variation and adjustment of the lateral thrusts on the ingot during its formation nor the correct self-adaptation of the containing elements to the movement and shrinkage of the metal.

Lastly, the elements of which the traditional downstream molds consist do not enable the starter bar that draws the ingot to be readily inserted, and these elements are hard to open.

The present invention aims, instead, to eliminate or at least to limit appreciably the above problems and shortcomings of the continuous casting of steel by means of improvements to the downstream mold itself and to the means which support, move and thrust the elements forming the downstream mold.

The invention has also been designed for application to any mold already in operation.

For this purpose the invention concerns an apparatus for the continuous casting of steel apparatus for the continuous casting of metals, which is suitable for vertical, curved or almost horizontal casting and comprises in association with a main ingot mold a downstream mold positioned immediately downstream of the mail ingot mold and consisting of a plurality of independent elements, the downstream mold being cooled with water, the apparatus providing for the formation of ingots with a round, oval, square or like section and being characterized in that the downstream mold consists of a plurality of independent, movable shell elements which can align themselves and have sides not parallel to the direction of sliding of the metal, the sides of each shell element delimiting in conjunction with the sides of the neighboring shall element clefts which have a development not parallel to, or according to a spiral in relation to, the axis and surface of the ingot being formed.

The invention is applied preferably and advantageously to downstream molds for the casting of ingots having a round section but can be applied also to downstream molds for the casting of ingots having a square section.

Moreover, in either case the invention is applied to straight as well as to curved downstream molds for the continuous casting of any type of steel and metal in general.

The special features of this invention are therefore the provision of a mold immediately downstream of the main mold and consisting of movable, independent shell elements, the contiguous sides of which are not positioned parallel to the direction of movement of the metal, and consisting also of fluid-type actuators to operate the shell elements. The actuators can be of a pneumatic or oleodynamic type.

Thus the clefts, which must not be eliminated and which exist between adjacent shell elements, have a disposition which is not parallel to, or else is like a spiral in relation to, the axis and surface of the ingot.

It follows that the metal moving according to the axis of the downstream mold is exposed to direct cooling only in the zones along the segment, and for the time required, to cross the clefts and therefore to a substantially unimportant extent in relation to the length of the downstream mold and the time needed to pass through it.

This arrangement therefore makes it possible to eliminate any preferred strip of surface solidification, to contain and regulate better and to make more uniform the cooling and solidification of the metallic mass, to make the crystallization homogeneous and to reduce the physical, structural and mechanical shortcomings cited above.

Next, the employment of pneumatic actuators, on the other hand, to control the individual shell elements forming the downstream mold permits these elements to be positioned better and also makes it possible to vary, regulate and make uniform the lateral containment thrust applied to the metallic mass at any time, even when the apparatus is working, to enable the shell elements forming the downstream mold to oscillate and, not lastly, to control the opening of the downstream mold for insertion of the starter bar.

The individual shell elements are also enabled to stay always in contact with the ingot passing through.

The attached figures show an example of the embodiment of an apparatus according to the invention, the apparatus being mainly intended for the formation of ingots having a round section in a continuous casting plant with a vertical axis. In the figures.

Figure 1:
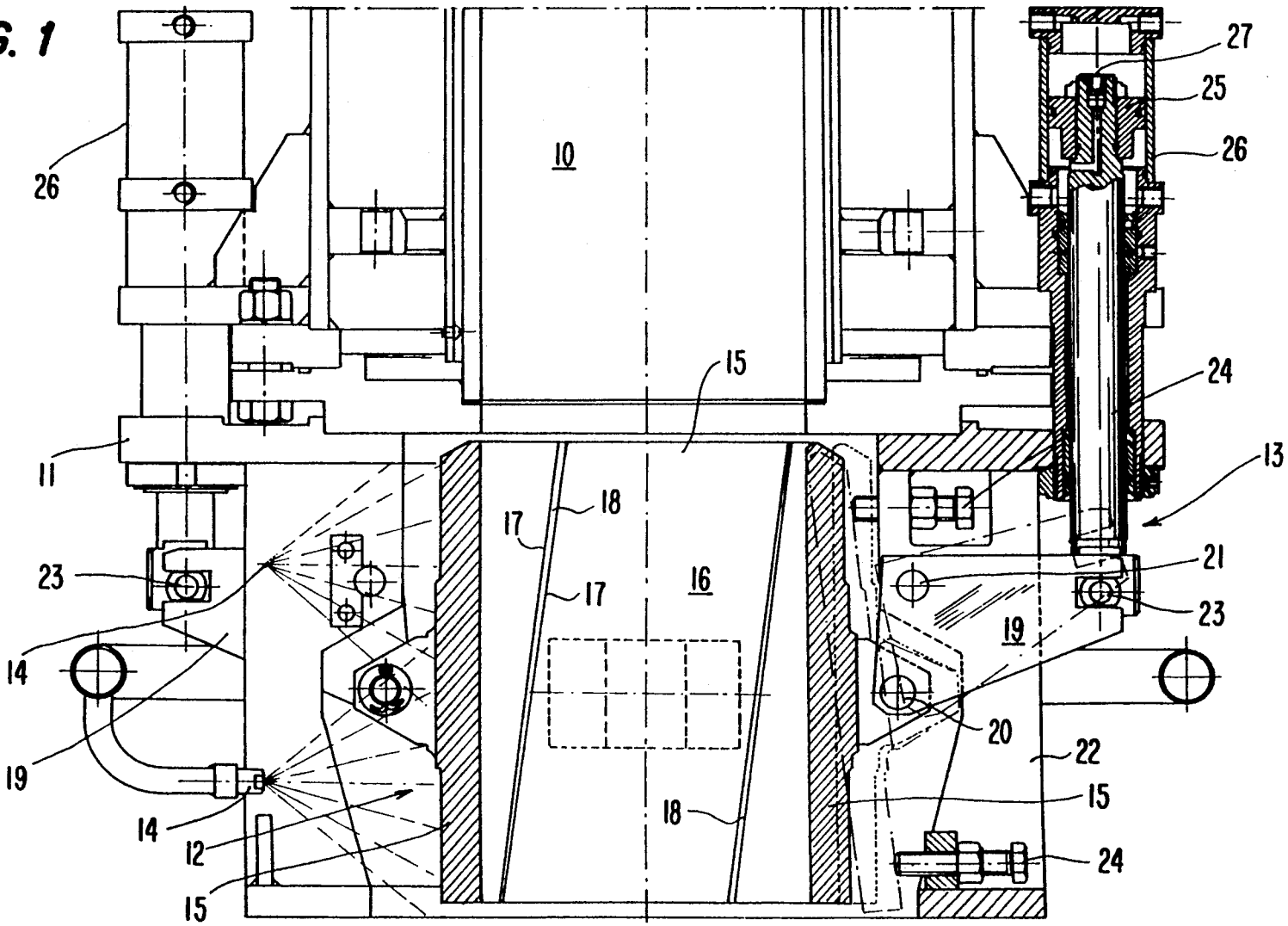
FIG. 1 shows a partial vertical section of the apparatus and, with lines of dashes, the possible oscillations of an element of a downstream mould positioned immediately downstream of the main mold.

The apparatus according to the invention is applied by means of a support plate 11 immediately downstream of a main ingot mold 10, which is known in itself; the apparatus comprises a downstream mold 12, pneumatic actuators 13 to actuate the downstream mold and nozzles 14 to deliver jets of water onto the surface of the downstream mold.

Figure 2:
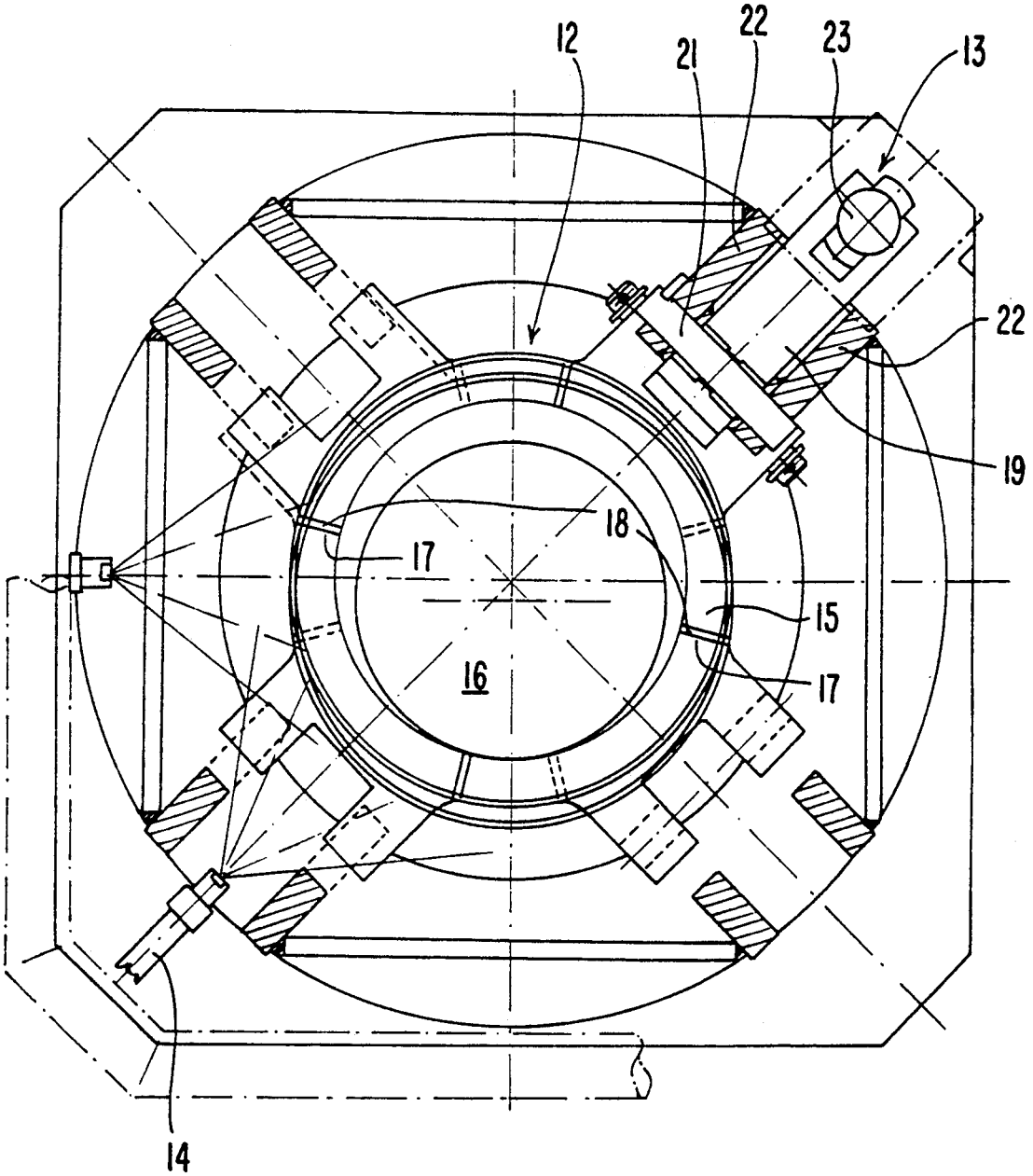
FIG. 2 shows a plan view of a partial section of the downstream mold.
Figure 3:
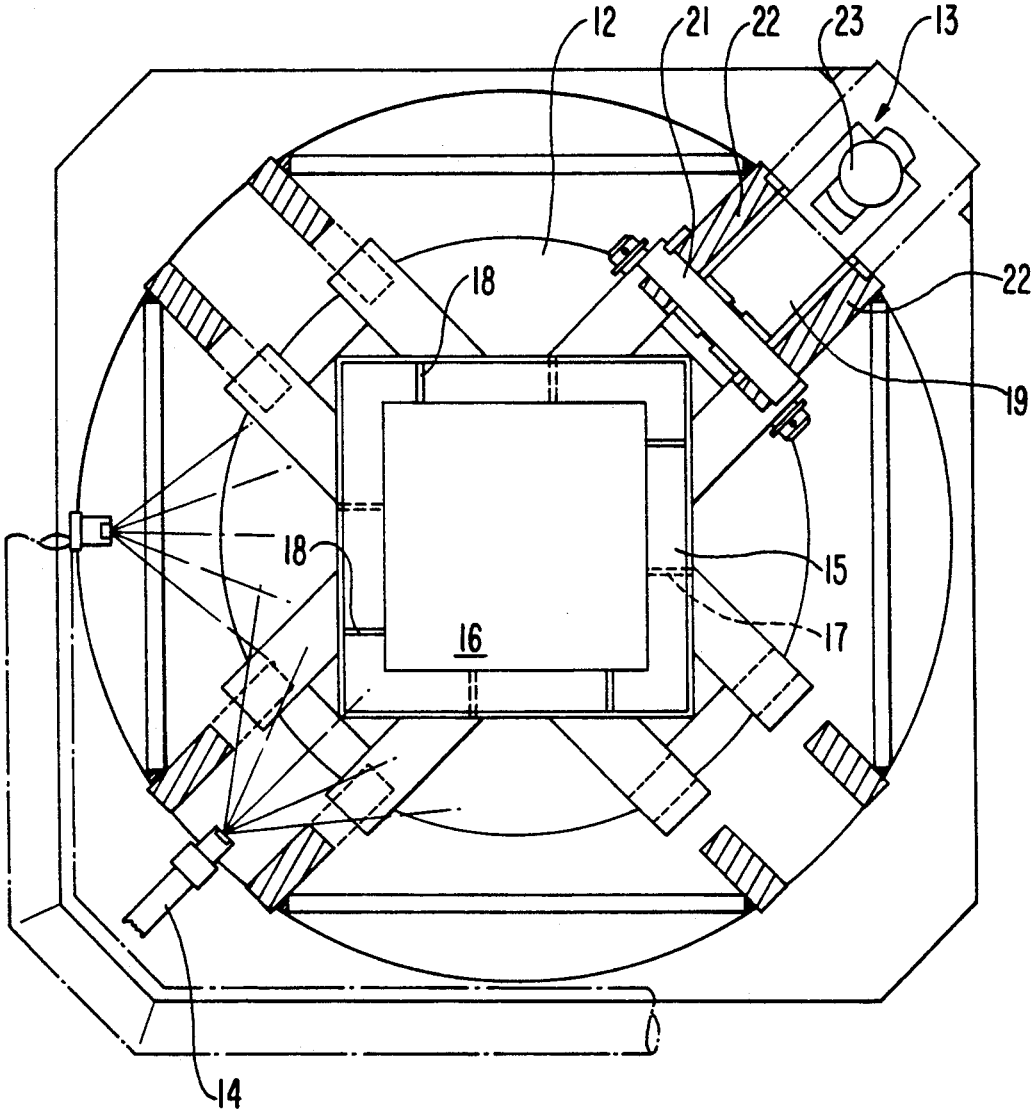
FIG. 3 shows a plan view of a partial section of a downstream mold having a square cross section.

The latter consists of a plurality (four, for instance) of independent shell elements 15 able to move independently of each other and to align themselves; in this case the elements 15 are arranged in a circle (FIG. 2) so as to define in conjunction a pipe 16 for the passage of metal coming from the main ingot mold 10, the pipe 16 being cylindrical or, preferably, tapered in a downstream direction.

Sides 17 of each shell element 15 are not parallel to the axis of the pipe 16 and to the direction of displacement of the metal in the downstream mold 12.

The sides 17 of each shell element 15 may be oblique, straight, curved, sinusoidal or in broken lines and define, together with the sides 17 of the neighbouring shell elements 15 (FIG. 1), clefts 18, which are also oblique, so as to achieve during the casting the conditions described above and to enable the individual shell elements 15 to move and adapt themselves continuously in an independent manner. The clefts 18 are continuous, while the shell elements 15 are independent.

Each shell element 15 is supported and positioned by a rocker lever 19, on which the shell element 15 is pivoted at 20 with the ability also to oscillate in a vertical plane.

The rocker lever 19 (FIG. 1) in turn is pivoted at 21 between two housings 22 secured to the support plate 11 and is articulated at 23 to a pneumatic control actuator 13 in such a way that to movements of the lever 19 there correspond movements of self-alignment and opening of each shell element 15 independently of or at the same as the other shell elements.

The oscillations of each shell element 15 on its pivot 20 are restricted, instead, by abutment screws 24 secured to the housings 22 (FIG. 1).

The pneumatic actuators 13, which can also be hydraulic or of another type suitable for the purpose and which actuate the shell elements 15 of the downstream mold 12, consist of pneumatic pistons 25 that operate in corresponding cylinders 26 and are fed in series and remote-controlled by an appropriate control assembly.

Each piston 25 has the special feature of being equipped with a calibrated bore 27 for the regulated passage of air from the chamber under pressure to the chamber not under pressure within the cylinder 26 and from the cylinder 26 to the return duct of the pneumatic circuit.

This makes possible a continuous exchange of air in the cylinders for the cooling of the same and mainly to avoid any overheating of the air and therefore variations of the thrust on the pistons and, through the levers, on the shell elements 15, such variations being caused by variations in air pressure resulting from variations in the temperature of the air.

It is therefore possible to set and keep constant in the long term the thrusts on the shell elements 15 in proportion to the metallostatic pressure for proper employment of the downstream mold and for a good outcome of the casting.

Moreover, the pneumatic actuators 13 enable the shell elements 15 to be actuated and the thrusts existing at any moment to be possibly modified and make possible also any correction required for the operations during the casting.

Lastly, the pneumatic actuators 13 enable the shell elements 15 to be moved when required in the direction of their separation and also make use of the possibility of oscillations on the pivot 20 of the elements 15 so as to facilitate insertion of a starter bar in the downstream mold 12.

Finally, it should be borne in mind that, without departing from the scope of the invention, it is possible, on the one hand, to employ the downstream mold as described above without having available pneumatic actuators and, on the other hand, it is possible to use the pneumatic actuation system with the same advantages and analogous purposes to operate a downstream mold also with the traditional plate-shaped elements to form ingots with a square section.

I claim:

1. An apparatus for vertical, curved or almost horizontal continuous casting of metal to form ingots comprising:

a main ingot mold; and a downstream mold, said downstream mold being cooled with water and having a longitudinal axis along which said metal slides, wherein said downstream mold is positioned immediately downstream of said main ingot mold and comprises a plurality of shell elements, each of said plurality of shell elements being independently movable and adapted to be aligned with one another such that each of said plurality of shell elements has sides not parallel to said longitudinal axis and such that clefts are delimitated by adjacent sides of neighboring ones of said plurality of shell elements, wherein each of said clefts extends in a direction not parallel to said longitudinal axis and intersects with said metal generally along a line not coplanar with said longitudinal axis wherein said clefts are arranged such that substantially all of the outer cross sectional surface of said metal intersects with said clefts as said metal slides through said downstream mold.

2. Apparatus as claimed in claim 1, in which the sides of the shell elements are oblique, straight, curved or sinusoidal or follow a broken line.

3. Apparatus as claimed in claim 1, in which each of said plurality of shell elements is operably connected to respective pneumatic actuators fed in series and remote-controlled to being together and to distance said plurality of shall elements reciprocally and to regulate the lateral containment thrusts applied to the ingot being formed.

4. Apparatus as claimed in claim 3, in which each of said plurality of shell elements is connected to one of said pneumatic actuators through a transmission rocker lever and is fitted so as to be able to oscillate on said rocker lever, said lever and pneumatic actuator being fitted to a support plate secured to the main ingot mold, wherein oscillations of each of said plurality of shell elements are restricted by abutments.

5. Apparatus as claimed in claim 4, in which each pneumatic actuator consists of a piston that operably movable within a cylinder, the piston (25) comprising a calibrated bore for the regulated passage of air from a chamber under pressure to a chamber not under pressure within the cylinder for the purposes of the exchange of air and the cooling of the cylinder.

6. An apparatus as claimed in claim 1, wherein said downstream mold has a cross-sectional shape perpendicular to said longitudinal axis which is one of round, oval and square.

7. An apparatus as claimed in claim 1, wherein said clefts extend in a spiral in relation to said longitudinal axis.

8. An apparatus for vertical, curved or almost horizontal continuous casting of metal to form ingots comprising:

a main ingot mold;

a downstream mold, said downstream mold being cooled with water and having a longitudinal axis along which said metal slides, wherein said downstream mold is positioned immediately downstream of said main ingot mold an comprises a plurality of independent, contiguous elements, each of said plurality of independent, contiguous elements being independently movable and adapted to be aligned with one another such that each of said plurality of independent, contiguous elements has sides not parallel to said longitudinal axis and such that clefts are delimitated by adjacent sides of neighboring ones of said plurality of independent, contiguous elements, wherein each of said clefts extends in a direction not parallel to said longitudinal axis and intersects with said metal generally along a line not coplanar with said longitudinal axis; and a plurality of pneumatic actuators fed in series and remote controlled, wherein each of said plurality of independent contiguous elements is operably connected to one of said plurality of pneumatic actuators wherein said clefts are arranged such that substantially all of the outer cross sectional surface of said metal intersects with said clefts as said metal slides through said downstream mold.

9. An apparatus as claimed in claim 8, wherein said downstream mold has a cross-sectional shape perpendicular to said longitudinal axis which is one of round, oval and square.

10. An apparatus as claimed in claim 8, wherein said clefts extend in a spiral in relation to said longitudinal axis.

* * * * *